US011255328B2

(12) United States Patent
Kolvenbach

(10) Patent No.: US 11,255,328 B2
(45) Date of Patent: Feb. 22, 2022

(54) MULTI-STAGE ROTARY LOBE PUMP

(71) Applicant: Leybold GmbH, Cologne (DE)

(72) Inventor: Dieter Kolvenbach, Cologne (DE)

(73) Assignee: LEYBOLD GMBH, Cologne (DE)

( * ) Notice: Subject to any disclaimer, the term of this patent is extended or adjusted under 35 U.S.C. 154(b) by 90 days.

(21) Appl. No.: 16/476,817

(22) PCT Filed: Jan. 24, 2018

(86) PCT No.: PCT/EP2018/051641
§ 371 (c)(1),
(2) Date: Jul. 9, 2019

(87) PCT Pub. No.: WO2018/149598
PCT Pub. Date: Aug. 23, 2018

(65) Prior Publication Data

US 2019/0376515 A1 Dec. 12, 2019

(30) Foreign Application Priority Data

Feb. 17, 2017 (DE) ..... 202017001029.1

(51) Int. Cl.
*F04C 23/00* (2006.01)
*F04C 18/08* (2006.01)
*F04C 18/12* (2006.01)

(52) U.S. Cl.
CPC ..... *F04C 23/001* (2013.01); *F04C 18/084* (2013.01); *F04C 18/126* (2013.01); *F04C 2240/30* (2013.01)

(58) Field of Classification Search
CPC .... F04C 18/126; F04C 18/084; F04C 23/001; F04C 2240/30
See application file for complete search history.

(56) References Cited

U.S. PATENT DOCUMENTS 3,198,120 A * 8/1965 Little, Jr. ..... F04C 14/02 417/252
5,816,782 A 10/1998 Nagayama et al.
7,108,492 B2 9/2006 Yamamoto et al.
(Continued)

FOREIGN PATENT DOCUMENTS

CN 101545487 A 9/2009
DE 69610352 T2 5/2001
(Continued)

OTHER PUBLICATIONS

International Search Report dated Apr. 6, 2018 for PCT application No. PCT/EP2018/051641.
(Continued)

*Primary Examiner* — Charles G Freay
(74) *Attorney, Agent, or Firm* — Ohlandt, Greeley, Ruggiero and Perle, LLP

(57) ABSTRACT

A multistage Roots pump comprise a plurality of pump chambers in a pump housing. They constitute respective pump stages, wherein each pump stage comprises two two-toothed rotary pistons. The pump stages are separated from each other by partition walls. In the partition walls essentially radially extending connecting ducts are arranged. The connecting ducts are connected with an inflow chamber whose inflow opening has a larger cross-section than the connecting ducts.

16 Claims, 2 Drawing Sheets

(56) References Cited

U.S. PATENT DOCUMENTS

| | | | | |
|---|---|---|---|---|
| 2005/0118035 | A1* | 6/2005 | Naito | F04C 25/02 417/244 |
| 2012/0014825 | A1 | 1/2012 | Izawa et al. | |
| 2014/0205482 | A1* | 7/2014 | Crochet | F04C 28/065 418/5 |

FOREIGN PATENT DOCUMENTS

| | | | | |
|---|---|---|---|---|
| DE | 602004004693 | T2 | | 11/2007 |
| EP | 1006281 | A1 | | 6/2000 |
| EP | 1020645 | A1 | | 7/2000 |
| EP | 1479913 | A2 | | 11/2004 |
| GB | 2088957 | A | | 6/1982 |
| GB | 2137696 | A | | 10/1984 |
| JP | S6188764 | | | 6/1986 |
| JP | S6319090 | U | | 2/1988 |
| WO | WO2016/035047 | | * | 3/2016 |

OTHER PUBLICATIONS

Office Action dated Sep. 21, 2021 in corresponding Japanese application No. 2019-540089 with English translation.

* cited by examiner

MULTI-STAGE ROTARY LOBE PUMP

BACKGROUND

1. Field of the Disclosure

The disclosure relates to a multistage Roots pump.

2. Discussion of the Background Art

Roots pumps comprise two-toothed rotary pistons arranged in a pump chamber, for example. The two rotary pistons provided per pump chamber are driven in opposite directions such that gas is taken in through the individual chambers via a main inlet and discharged via a main outlet. Here, the main inlet as well as the main outlet extend in a radial direction and are arranged opposite each other. Further, multi-toothed rotary pistons, in particular such comprising three or four teeth, are known. Here, too, the gas is essentially radially pumped from a radially arranged main inlet to a radially arranged main outlet.

Further, for attaining low pressures, multistage Roots pumps are known. Such Roots pumps comprise a pair of rotary pistons per stage. Here, the gas to be pumped is delivered from an outlet of a pump stage to an inlet of an adjacent pump stage. This is realized via connecting ducts. The connecting ducts can be arranged in the housing of the Roots pump, as described in US 2010/0158728, wherein the connecting ducts surround the pump chambers in which the rotary pistons are arranged, or are arranged radially outside the pump chambers, respectively. This is required for delivering gas from an outlet of a pump stage arranged in lower area of the Roots pump to an inlet of the adjacent pump stage arranged in the opposite, for example upper, area of a Roots pump. Such Roots pumps are disadvantageous in that the configuration of the ducts in the housing is technically complex. Further, the housing must have a large volume for accommodating the connecting ducts. This does not only result in large outer dimensions of the Roots pumps but in particular also involves high costs. The high costs are attributable not only to the complex manufacturing process but also to the large amount of metal required.

Further, from WO 2013/023954 multistage Roots pumps are known where the rotary pistons comprise three or more teeth. Here, the connecting ducts between adjacent pump chambers are arranged in the partition walls which separate adjacent pump chambers from each other. Since three or more teeth per rotary piston are provided it is possible that the connecting ducts are exclusively axially arranged in the partition walls. Since such an axial arrangement of connecting ducts is possible only in the case of three- or multi-toothed rotary piston pumps, such a pump is disadvantageous in that the suction capacity is smaller than that of Roots pumps having two-toothed rotary pistons.

Another Roots pump having three-toothed rotary pistons is known from US 2005/0089424. This is a multistage Roots pump, wherein the individual pump stages are separated from each other by partition walls. The connecting ducts between the pump stages are arranged in the partition walls. Here, the connecting ducts are of a Z-shaped configuration. Thus the connecting ducts comprise an inlet area, a radially extending connecting area and an axially extending outlet area. This leads to high flow losses.

It is an object of the disclosure to provide a multistage Roots pump by means of which high suction capacities can be attained.

SUMMARY

The multistage Roots pump according to the disclosure comprises a plurality of pump chambers defined in a pump housing. In each one of the pump chambers two two-toothed rotary pistons for defining a pump stage are arranged. Adjacent pump stages are separated from each other by partition walls. In the partition walls connecting ducts for connecting the adjacent pump stages with each other are arranged. According to the disclosure, the connecting ducts are configured such that at least one, preferably all connecting ducts are connected with an axial inflow chamber, through which connecting ducts the delivered medium flows from the pump chamber of a pump stage into the inflow chamber via an inflow opening. According to the disclosure, the inflow opening is configured such that the cross-section of the inflow opening is larger than the cross-section of the connecting duct. With the aid of a configuration of the multistage Roots pump with two-toothed rotary pistons according to the disclosure, a high suction capacity can be attained. By providing an inflow chamber comprising a large inflow opening, the flow resistances can be reduced even in the case of connecting ducts arranged in the partition walls and thus being shorter. This reduces the power consumption of the pump and increases the suction capacity and thus the efficiency of the pump.

Since, according to the disclosure, this is a Roots pump comprising two-toothed rotary pistons, it is preferred that the connecting duct between two pump stages is essentially in particular exclusively radially arranged and extends completely in the partition wall. The connecting duct thus comprises an in particular exclusively radially extending duct section. It is particularly preferred that the overall connecting duct is radially arranged, wherein the connecting duct is in particular preferably directly connected with an upstream axial inflow chamber a seen in the direction of flow. It is particularly preferred that an axial outflow chamber is additionally provided which preferably is also directly connected with the radially extending connecting duct. The outflow chamber is then connected with the next pump stage via an outflow opening, wherein the outflow opening of the connecting duct constitutes the inlet of the next pump stage.

Preferably, the inflow opening of the inflow chamber has a larger cross-section than the radial duct section of the connecting duct and in particular than the essentially exclusively radially extending connecting duct. It is in particular preferred that the cross-section of the inflow opening is by at least 10%, in particular at least 20%, and more preferably at least 30% larger than the cross-section of the connecting duct.

For further reducing the occurring flow resistances, it is further preferred that preferably all edges at the inlet opening, preferably also at the transitions between the inflow chamber and the connecting duct are rounded by radii in a flow-enhancing manner. Preferably, the radius of the rounded portion is larger than two millimeters.

According to another preferred embodiment, a prechamber is provided upstream of the inflow chamber as seen in the direction of flow. The delivered medium to be tested thus travels at least partly first into a prechamber before it is then passed on into the inflow chamber. If necessary, the arrangement of the prechamber and the inflow chamber can however be such that the medium can also directly travel from the pump chamber into the inflow chamber. Such a configuration further reduces the flow resistances. Providing a prechamber is an independent disclosure independent of the cross-section of the inflow opening.

According to a particularly preferred aspect, the prechamber is arranged radially with respect to the pair of rotary pistons. This offers the advantage that the medium to be delivered need not be redirected when flowing into the prechamber. It is thus particularly preferred that the prechamber is configured as a portion of the pump chamber into which the rotary pistons do not project. More preferably, the prechamber extends across the overall width of the pump chamber such that a flow-resistance-free inflow of the medium into the prechamber is possible.

According to a particularly preferred aspect of the disclosure, the connecting ducts arranged in the partition walls are additionally connected with an outflow chamber. Here, it is preferred that the connection is realized in a direct manner, wherein, preferably, the connecting duct is exclusively radially arranged in the partition walls. Preferably, the outflow chamber comprises an outflow opening. Here, the cross-section of the outflow opening is preferably configured such that it is larger than the cross-section of the connecting duct. The cross-section of the outflow opening is preferably by 10%, in particular 20% and more preferably 30% larger than the cross-section of the connecting duct. In addition, in this area, too, the edges are preferably rounded as in the area of the inflow chamber.

According to a particularly preferred aspect of the disclosure, preferably a postchamber is provided. This is arranged downstream of the outflow chamber as seen in the direction of flow. Here, the postchamber can be arranged and configured such that the medium completely or only partly flows from the outflow chamber into the postchamber through the outflow opening. The medium can thus flow into the next pump chamber, possibly partly directly from the outflow opening, or can completely or partly first flow into the postchamber to then flow from there into the next pump chamber. Preferably, the postchamber is configured such that it corresponds to the prechamber. In particular, the postchamber is preferably arranged radially with respect to the pair of rotary pistons. Here, again, it is preferred that the rotary pistons do not project into the prechamber, and the prechamber extends in particular across the overall width of the pump stage.

According to a particularly preferred aspect of the disclosure, the housing comprises at least one inlet cover. The at least one inlet cover in particular nearly completely constitutes a sidewall of the inflow chamber. By opening or removing the at least one inlet cover, the inflow chamber is easily accessible for cleaning purposes, for example. Further, by providing the at least one inlet cover, the geometry is simplified, which facilitates the manufacture.

According to a preferred aspect, an additional inlet cover is provided, for example, which constitutes a side wall of the prechamber. This side cover, too, is preferably configured such that it completely constitutes the wall such that the prechamber is easily accessible for cleaning purposes, for example. Thereby, too, the geometry is simplified and thus a more inexpensive manufacture is possible. Further, via the inlet cover of the prechamber the pump chamber is easily accessible.

It is particularly preferred that a side cover constitutes both a sidewall of the inflow chamber and of the prechamber. According to a particularly preferred aspect, the inlet cover extends across at least two adjacent pump stages, and more preferably across all pump stages of the multistage Roots pump.

According to a preferred aspect, the housing comprises at least one outlet cover which constitutes a sidewall of the outflow chamber. Here, the outlet cover is preferably configured such that it corresponds to the inlet cover, wherein in particular an outlet cover for a postchamber is provided, and according to a particularly preferred embodiment, the outlet cover extends across one or a plurality of pump stages, in particular across all pump stages.

BRIEF DESCRIPTION OF THE DRAWINGS

Hereunder the disclosure is explained in detail on the basis of a preferred embodiment with reference to the accompanying drawings in which.

DETAILED DESCRIPTION OF THE PREFERRED EMBODIMENT

Figure 1:
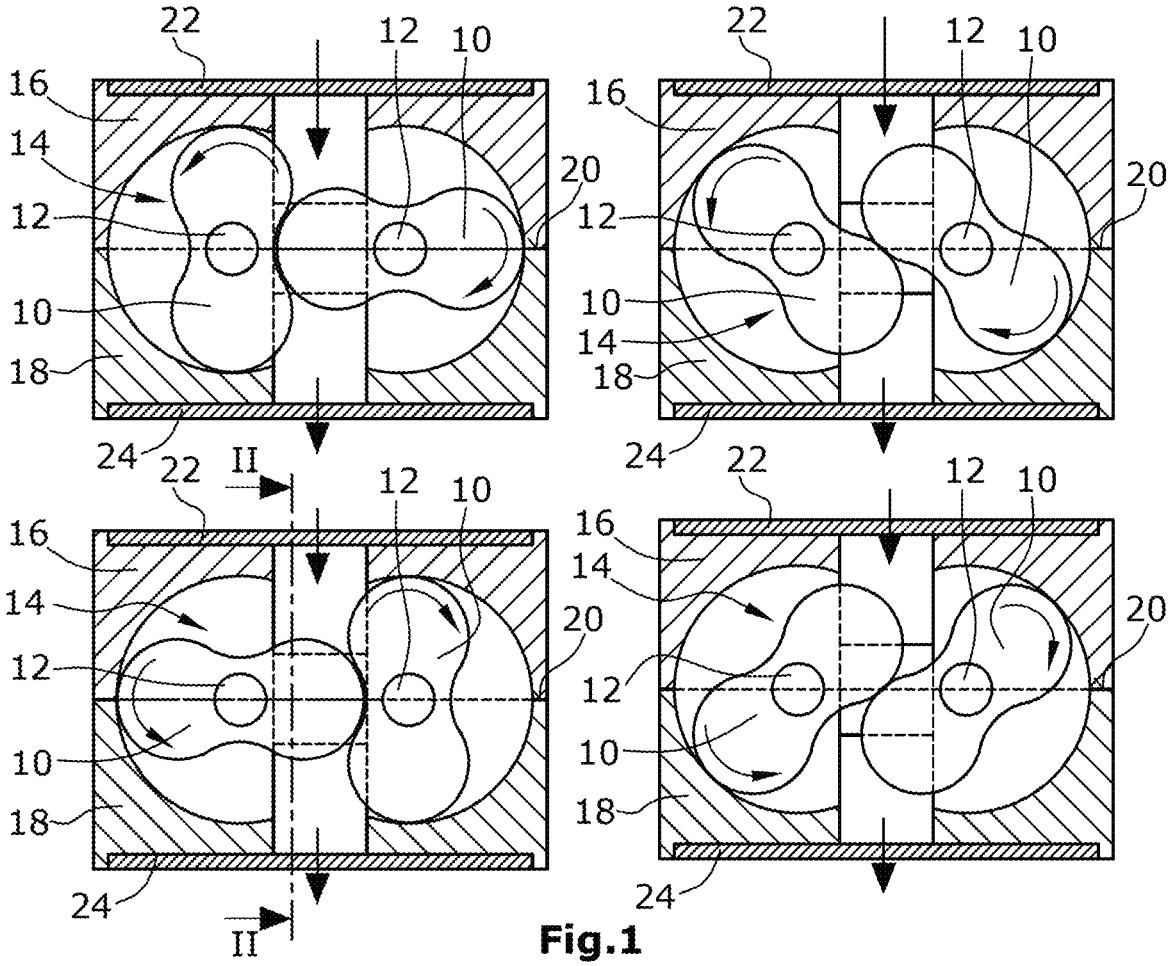
FIG. 1 shows a cross-section of schematic diagrams of a two-stage Roots pump according to the disclosure in different rotational positions of the pair of rotary pistons.

Each pump stage of the multistage Roots pump according to the disclosure comprises a pair of rolling pistons. The pair of rolling pistons comprises two two-toothed rotary pistons 10. They are each arranged on a shaft 12 and are rotated in opposite directions for delivering the medium. The individual rolling pistons of the successively arranged pump stages are each disposed on a common shaft such that the Roots pump comprises two shafts 12. The rolling pistons 10 of a respective pair of rolling pistons are arranged in a pump chamber 14 constituting a pump stage. The pump chamber is formed by a bipartite housing 16, 18. Here, a partition 20 of the housing is provided in the center of the two shafts 12 such that a simple assembly is possible. In addition, the housing is provided with an inlet cover 22 and an outlet cover 24.

Figure 2:
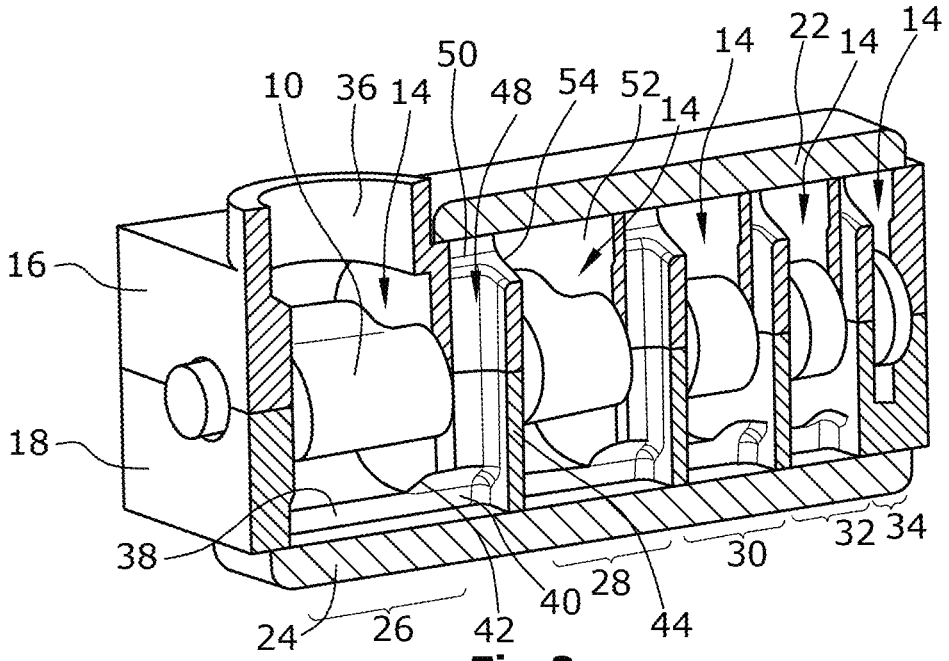
FIG. 2 shows a schematic perspective longitudinal section of the multistage Roots pump according to the disclosure.

From the schematic longitudinal section along a line II-II of FIG. 1 illustrated in FIG. 2 it can be seen that the Roots pump according to the disclosure is configured as a multistage Roots pump, wherein, in an axial direction, a plurality pump stages 26, 28, 30, 32, 34 are provided. The chamber volumes of the individual pump stages decrease starting from the pump stage 26 towards the pump stage 34. The first pump stage 26 is connected with a main inlet 36. The main inlet 36 is connected with a chamber to be evacuated or the like. The medium to be delivered thus radially flows into the pump chamber 14 of the first pump stage 26 through the main inlet 36.

In the radial direction, opposite the main inlet 36, a prechamber 38 is formed. The prechamber 38 extends across the overall axial width of the pump stage 26 and thus has essentially the same width as the rolling pistons 10 of the first pump stage 26.

In addition, an inflow chamber 40 is provided. The inflow chamber 40 is arranged adjacent to the prechamber 38 on the one hand and further comprises an inflow opening 42 directly connected with the pump chamber 14 in the illustrated exemplary embodiment.

A connecting duct 48 arranged inside a partition wall 44 is disposed adjacent to the inflow chamber 40. In FIG. 2 the medium to be delivered flows from top to bottom in the connecting duct 48.

Adjacent to the connecting duct 48, which exclusively radially extends in the illustrated exemplary embodiment, an outflow chamber 50 configured such that it corresponds to the inflow chamber 40 is arranged, and adjacent to the latter a postchamber 52 configured such that it corresponds to the prechamber 38 is arranged. The outflow chamber 50 comprises an outflow opening 54 whose contour and configuration match those of the inflow opening 42 in the illustrated exemplary embodiment.

In the illustrated exemplary embodiment, all pump stages are configured such that they correspond to each other, wherein the pump stages are respectively separated from each other by partition walls 44, and in each partition wall 44 a radially extending connecting duct 48 is arranged in the illustrated exemplary embodiment. Each connecting duct 48 is respectively connected with an inflow chamber 40 and an outflow chamber 50 as well as a prechamber 38 and a postchamber 52.

In particular for reducing the flow resistances, the inlet openings 42 of the inflow chambers 40 as well as preferably also the outflow openings 54 of the outflow chambers 50 are configured such that they have a larger cross-section than the connecting ducts 48.

Further, both the inflow chambers 40 and the prechambers 38 are connected with a common inlet cover 24. Correspondingly, the outflow chambers 50 as well as the postchambers 52 are connected with a common outlet cover 22.

The final pump stage 34 is further connected with a main outlet not illustrated through which the medium to be delivered is discharged.

Figure 3:
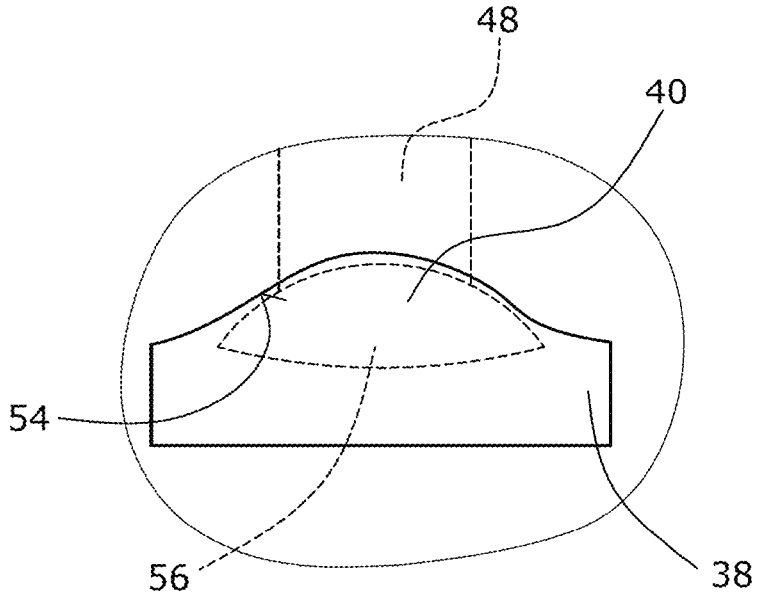
FIG. 3 shows a top view schematically showing an inlet area of the inflow chamber.

In FIG. 3 a schematic top view of an inlet chamber 40 is illustrated which is connected with a prechamber 38 on the one hand and with a connecting duct 48 on the other hand. In the illustrated exemplary embodiment, the inlet opening 42 is formed by the curved edge 54. Thus the inlet opening has the cross-section shown by the dashed line 56.

As can further be seen, the inflow chamber 40 is directly connected with the corresponding pump chamber 14 on the one hand and with the prechamber 38 on the other hand. The same applies to the outflow opening 54.

What is claimed is:

1. A multistage Roots pump, comprising:

a first pump chamber and a second pump chamber defined by a pump housing, two two-toothed rotary pistons defining a pump longitudinal axis and being arranged in the first and second pump chambers to define a first pump stage adjacent to a second pump stage, a partition wall separating the first and second pump stages from each other, and a connecting duct arranged in the partition wall, wherein the connecting duct is connected with an axial inflow chamber into which a delivered medium flows from the first pump chamber through an inflow opening, and wherein said inflow opening has a larger cross-section than the connecting duct, wherein the pump housing comprises:

an outlet cover which constitutes a sidewall of the axial inflow chamber and a sidewall of a prechamber of the first pump chamber, and an inlet cover which constitutes a sidewall of an outlet chamber and a sidewall of a postchamber of the second pump chamber.

2. The multistage Roots pump according to claim 1, wherein the connecting duct is radially arranged with respect to the pump longitudinal axis.

3. The multistage Roots pump according to claim 2, wherein the connecting duct is directly connected with the inflow chamber.

4. The multistage Roots pump according to claim 1, wherein all edges of the inflow opening are rounded.

5. The multistage Roots pump according to claim 1, wherein the prechamber is arranged upstream of the inflow chamber as seen in a direction of flow.

6. The multistage Roots pump according to claim 5, wherein the prechamber is arranged radially with respect to the two two-toothed rotary pistons.

7. The multistage Roots pump according to claim 5, wherein the prechamber is a portion of the first pump chamber into which the two two-toothed rotary pistons do not project.

8. The multistage Roots pump according to claim 1, wherein the connecting duct is directly connected with the outflow chamber.

9. The multistage Roots pump according to claim 8, wherein an outflow opening of the outflow chamber, through which the delivered medium flows out into the second pump chamber, has a larger cross-section than the connecting duct.

10. The multistage Roots pump according to claim 9, wherein all edges of the outflow opening are rounded.

11. The multistage Roots pump according to claim 8, wherein the postchamber is arranged downstream of the outflow chamber as seen in a direction of flow.

12. The multistage Roots pump according to claim 11, wherein the postchamber is arranged radially with respect to the two two-toothed rotary pistons.

13. The multistage Roots pump according to claim 11, wherein the postchamber is a portion of the second pump chamber into which the two two-toothed rotary pistons do not project.

14. The multistage Roots pump according to claim 1, wherein the inlet cover extends across the first and second pump stages.

15. The multistage Roots pump according to claim 14, wherein the outlet cover extends across the first and second pump stages.

16. The multistage Roots pump according to claim 1, wherein the outlet cover extends across the first and second pump stages.

* * * * *